US007228939B1

(12) United States Patent
Prater

(10) Patent No.: US 7,228,939 B1
(45) Date of Patent: Jun. 12, 2007

(54) PLATFORM LIFT

(76) Inventor: Stephen J. Prater, 7102 Forestwind Ct., Arlington, TX (US) 76001

( * ) Notice: Subject to any disclaimer, the term of this patent is extended or adjusted under 35 U.S.C. 154(b) by 223 days.

(21) Appl. No.: 10/810,523

(22) Filed: Mar. 26, 2004

Related U.S. Application Data

(60) Provisional application No. 60/458,684, filed on Mar. 28, 2003.

(51) Int. Cl.
*E04G 1/00* (2006.01)

(52) U.S. Cl. ..... 182/141

(58) Field of Classification Search ..... 182/141, 182/144, 145, 148
See application file for complete search history.

(56) References Cited

U.S. PATENT DOCUMENTS

| | | | | |
|---|---|---|---|---|
| 737,377 | A | 8/1903 | England | |
| 2,043,128 | A | 6/1936 | Sutton | |
| 2,066,984 | A | 1/1937 | Lamb | |
| RE20,653 | E | 2/1938 | Lamb | |
| 3,311,191 | A * | 3/1967 | Hiyama | 182/131 |
| 3,465,846 | A | 9/1969 | Jacobson | |
| 4,440,265 | A * | 4/1984 | Spagnoli | 182/129 |
| 4,727,959 | A | 3/1988 | Kummer | |
| 4,776,429 | A * | 10/1988 | Osborn | 182/144 |
| 5,295,557 | A | 3/1994 | Taylor | |
| 5,423,396 | A | 6/1995 | Fahrion | |
| 5,667,167 | A | 9/1997 | Kistler | |
| 5,701,704 | A | 12/1997 | Landes | |
| 5,807,168 | A | 9/1998 | Goldbach | |
| 5,823,291 | A | 10/1998 | Goldbach | |
| 6,102,157 | A | 8/2000 | Goldbach et al. | |
| 6,186,273 | B1 | 2/2001 | Goldbach et al. | |
| 2002/0062686 | A1* | 5/2002 | Keaton et al. | 73/116 |
| 2005/0198797 | A1* | 9/2005 | Appleton et al. | 29/401.1 |

* cited by examiner

*Primary Examiner*—Alvin Chin-Shue
(74) *Attorney, Agent, or Firm*—Geoffrey A. Mantooth

(57) ABSTRACT

A platform lift has support posts, and a platform that is coupled to the lift so as to be capable of being raised and lowered relative to the posts. A lifting mechanism moves the platform up and down relative to the posts. The platform has support structure and decking located on top of the support structure so as to provide a work area. An opening is provided in the support structure and the decking, which opening receives an engine, such as an aircraft engine. The platform provides a work area around the entire circumference of the engine, while the platform can be raised or lowered to provide access along the length of the engine. Filler plates can be provide so as to change the size of the opening to work on engines of different diameters.

8 Claims, 4 Drawing Sheets

35
43
45
87

45
31
37
45
45
131
99
83
51
43
85
133
21
33
31P
37P
33P
97

FIG 2
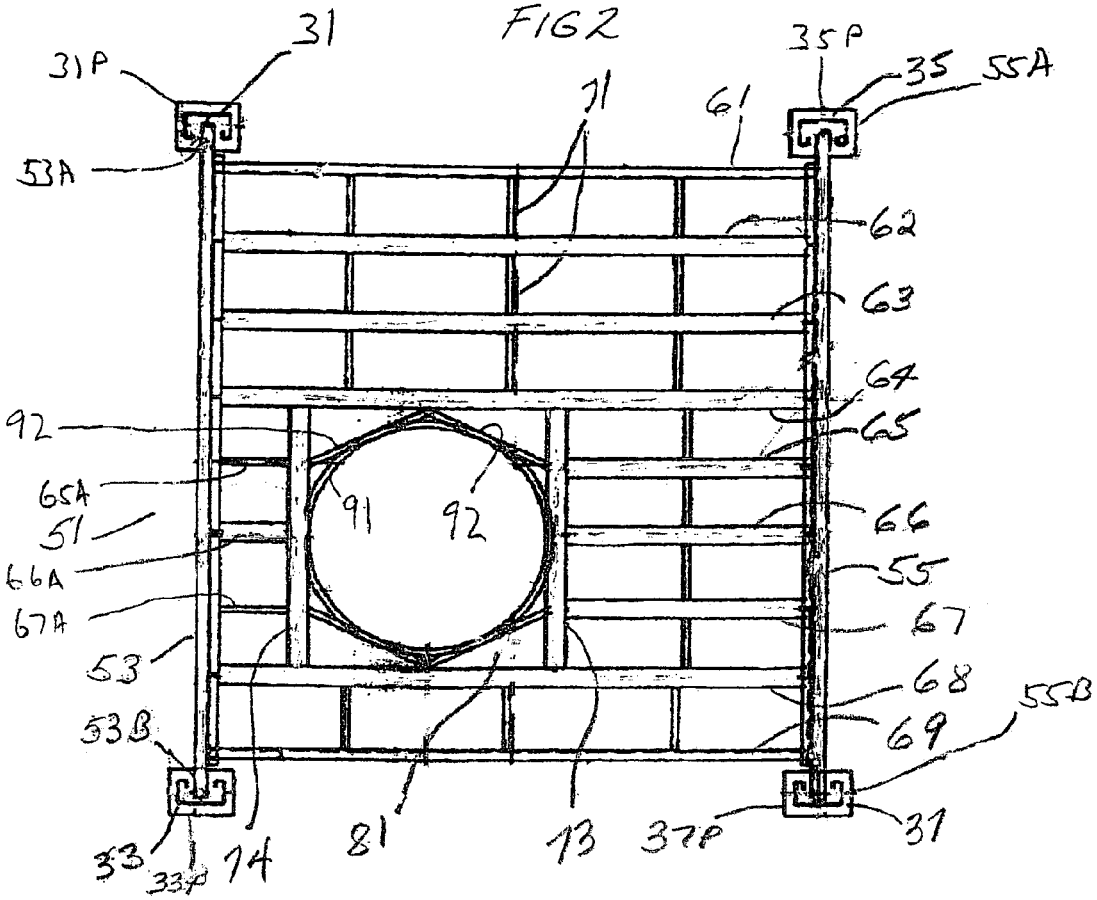
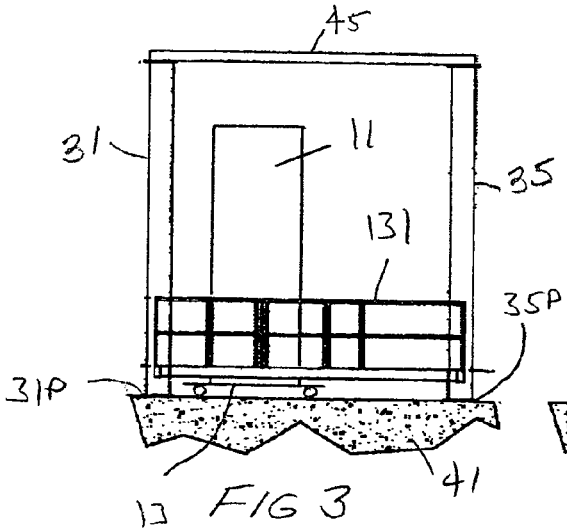
FIG 3
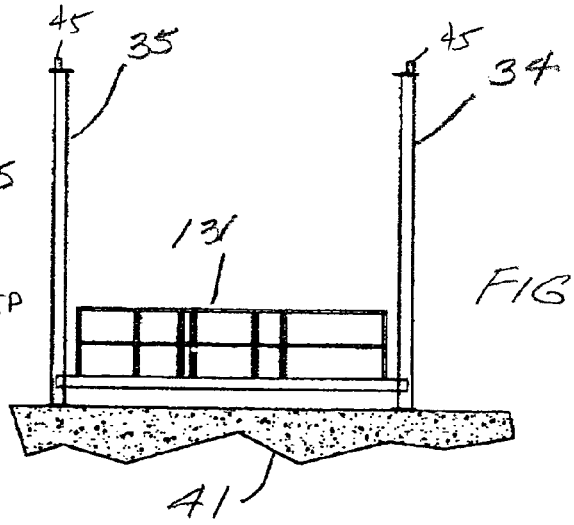
FIG 4

PLATFORM LIFT

This application claims the benefit of U.S. provisional patent application Ser. No. 60/458,684, filed Mar. 28, 2003.

FIELD OF THE INVENTION

The invention relates to a platform lift for the assembly and maintenance of aircraft or rocket components.

BACKGROUND OF THE INVENTION

Aircraft engines must be periodically maintained in order to ensure reliability and meet safety standards. Because the entire circumference of the engine must be accessed, the engine is either oriented vertically, on one end, or suspended horizontally.

In the prior art, vertically oriented engines are placed onto an elevator which descends into a pit in the ground. The construction of an elevator pit is expensive. A pit also poses environmental problems, as fluids leak out of the engines and into the pit, wherein the fluids can then enter the ground.

Also, in the prior art, horizontally suspended engines utilize a monorail-type device. Monorail systems are expensive to install and maintain. In addition, workers accessing the underside portion of the engine must work overhead, which is a difficult and awkward position.

Still another prior art device is scaffolding. The scaffolding must be carefully positioned so as to both safely hold workers and refrain from damaging the engine from adverse contact. Moving and stabilizing the scaffolding is time consuming and expensive.

SUMMARY OF THE INVENTION

It is an object of the present invention to provide a lift that provides a vertically movable platform that allows workers easy access to all sides of an aircraft engine.

It is another object of the present invention to provide a lift for use for working on an aircraft engine that is stable and that will not harm the engine.

The present invention provides a lift apparatus for use in working on engines. The lift apparatus comprises four vertically oriented support posts that are spaced apart from one another. A platform extends between and is supported by the posts. The platform comprises support structure and decking on top of the support structure. There is an opening in the support structure and the decking, which opening is structured and arranged to receive an engine. A lifting mechanism raises and lowers the platform along the posts.

In accordance with one aspect of the present invention the lift apparatus further comprises a guard rail around the opening.

In accordance with another aspect of the present invention the platform decking further comprises filler plates that surround the opening, the filler plates allowing the size of the opening to be adjusted.

In accordance with another aspect of the present invention the opening is circular.

In accordance with another aspect of the present invention the support structure further comprises a hoop-shaped beam around the opening.

In accordance with another aspect of the present invention the hoop-shaped beam is coupled to the support structure by tangential members.

In accordance with another aspect of the present invention the lift apparatus further comprises a controller for the lifting mechanism.

BRIEF DESCRIPTION OF THE DRAWINGS

FIG. 2 is a top plan view of the lift of FIG. 1 and platform support structure.

FIG. 3 is a side view of the lift with the platform in a lower position.

FIG. 4 is another side view of the lift as seen 90 degrees from the view of FIG. 3 with the platform in a lower position.

DESCRIPTION OF THE PREFERRED EMBODIMENT

The platform lift 21 is designed for use in conjunction with aircraft engines (such as jet or turbine engines) and also with rocket engines. FIG. 3 shows the lift 21 and an engine 11. The engine is mounted vertically, with one end (either the intake or the exhaust end) on top and the other end on the bottom. The engine is mounted onto a cart 13 or base, which cart can be rolled from place to place.

Figure 5:
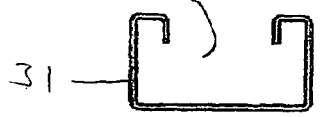
FIG. 5 is a top plan view of one of the posts.

The lift 21 comprises four metal posts 31, 33, 35, 37 secured to a concrete base 41 by way of lower plates 31P, 33P, 35P, 37P to form a rectangle. The posts are located at the corners of the rectangle. In one preferred embodiment, the height of the post from the base 41 may be 17 feet. In transverse cross-section, each post is generally "U"-shaped, as shown in FIG. 5. The cross-sectional dimensions of each post, in a preferred embodiment, may be 8 inches×14.75 inches. Each of the platform posts has a side opening 43 (see FIG. 5) on one side of the posts and extending along the length of the post such that the side openings 43 of posts 31 and 33 face each other and the side openings 43 of posts 35 and 37 face each other.

Figure 1:
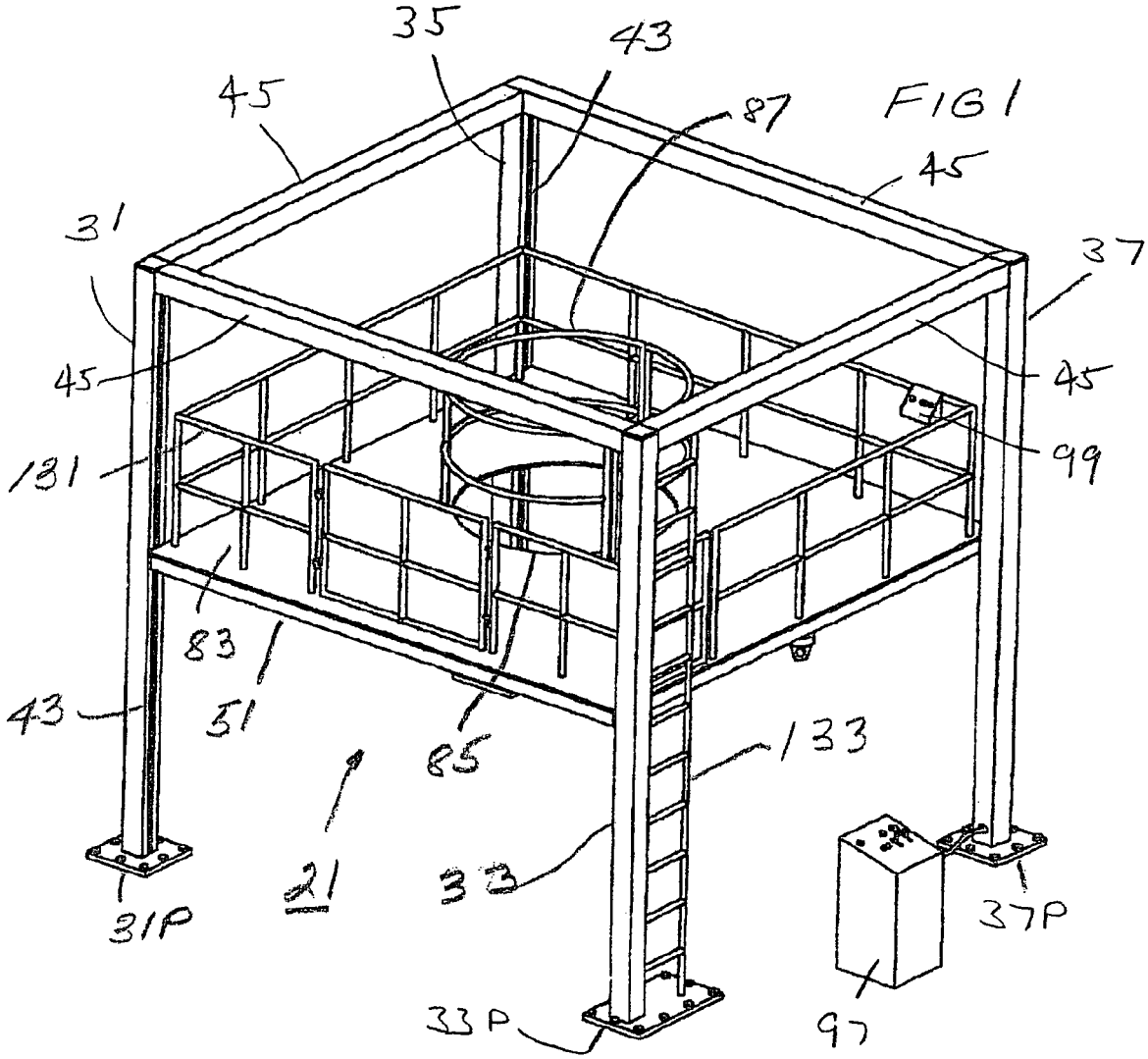
FIG. 1 is an isometric view of the platform lift of the invention, in accordance with a preferred embodiment.

Because the posts 31–37 are so tall, the top ends are coupled together to provide stability. As shown in FIG. 1, beams 45 are provided for this purpose. The beams 45 are in a rectangular configuration. Alternatively, two parallel beams 45 can be used, as shown in FIGS. 3 and 4. This leaves clearance for an overhead crane to pass through.

A platform 51 is provided which is supported for vertical movement between the four posts. The platform 51 comprises two main beams 53 and 55 secured together at spaced apart positions by cross beams 61–64, 68–69. The beam ends 53A, 53B are located in slots 43 of posts 31 and 33 and the beam ends 55A, 55B are located in the slots 43 of posts 35 and 37 for vertical sliding movement guided by the walls of the slots. Smaller cross beams 71 are also provided. A rectangular opening 81 is formed between beams 64 and 68 and cross beams 73 and 74. Beams 65–67 extend from beam 55 to cross beam 73, while beams 65A–67A extend from beam 53 to cross beam 74. In FIG. 2, the location of the opening is shown as off-center from the platform. This allows the platform to carry various equipment, and to position such equipment so as not to interfere with the workspace around the engine. The opening could be centered or located elsewhere in the platform 51.

A circular support structure is provided inside of the rectangular opening. The circular support structure has a beam 91 that is rolled or bent into a circle. The inside diameter is large enough to receive the engine 11 with some clearance between the engine and the circular beam 91. The circular beam is coupled to the remainder of the platform by tangential members 92. These are members or beams that contact the circular beam 91 at a tangent; the ends of the members are coupled to the beams 64, 73, 68, 74 of the opening 81. At least some the tangential members 92 can be the beams 64, 73, 69, 74 themselves.

Decking 83 on top of the beams forms a floor. The decking is secured to the beams. The decking has a circular opening 85 (see FIG. 1) formed therethrough so as to be in alignment with the circular beams 91.

Figure 7:
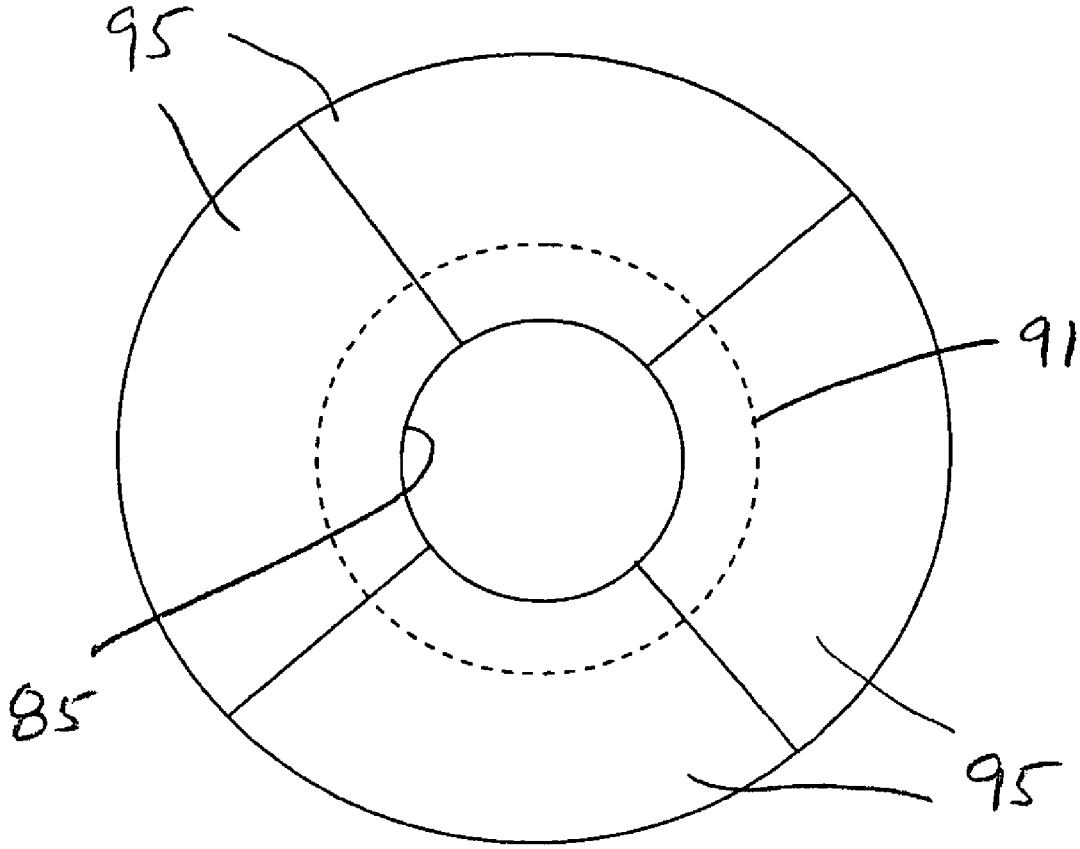
FIG. 7 is a top plan view showing filler plates used to diminish and/or adjust the size of the platform opening.

The size of the opening 85 in the decking can be adjusted by using filler plates 95 (see FIG. 7). The filler plates have a circular edge or inside diameter of the desired radius. The filler plates 95 are laid in place onto the regular decking 83 and bolted in place to extend inward of the circular beam 91 (shown in dashed lines in FIG. 7). Different sets of filler plates 95 can be provided to accommodate different engine diameters. For a large diameter engine, a set of filler plates 95 with a large inside diameter is used. For a smaller diameter engine, a set of filler plates with a smaller inside diameter is used, so as to minimize the space or annulus between the engine and the deck 83 and to allow workers to position themselves closer to the engine.

A cylindrical guard rail 87 is secured to the floor 83 around the opening 85 and which extends upward from the floor 83. The guard rail 87 can be removed and may not be needed if the annulus between the deck and the engine is small enough. The floor 83 may have dimensions of 16 feet by 16 feet. These dimensions may vary.

Figure 6:
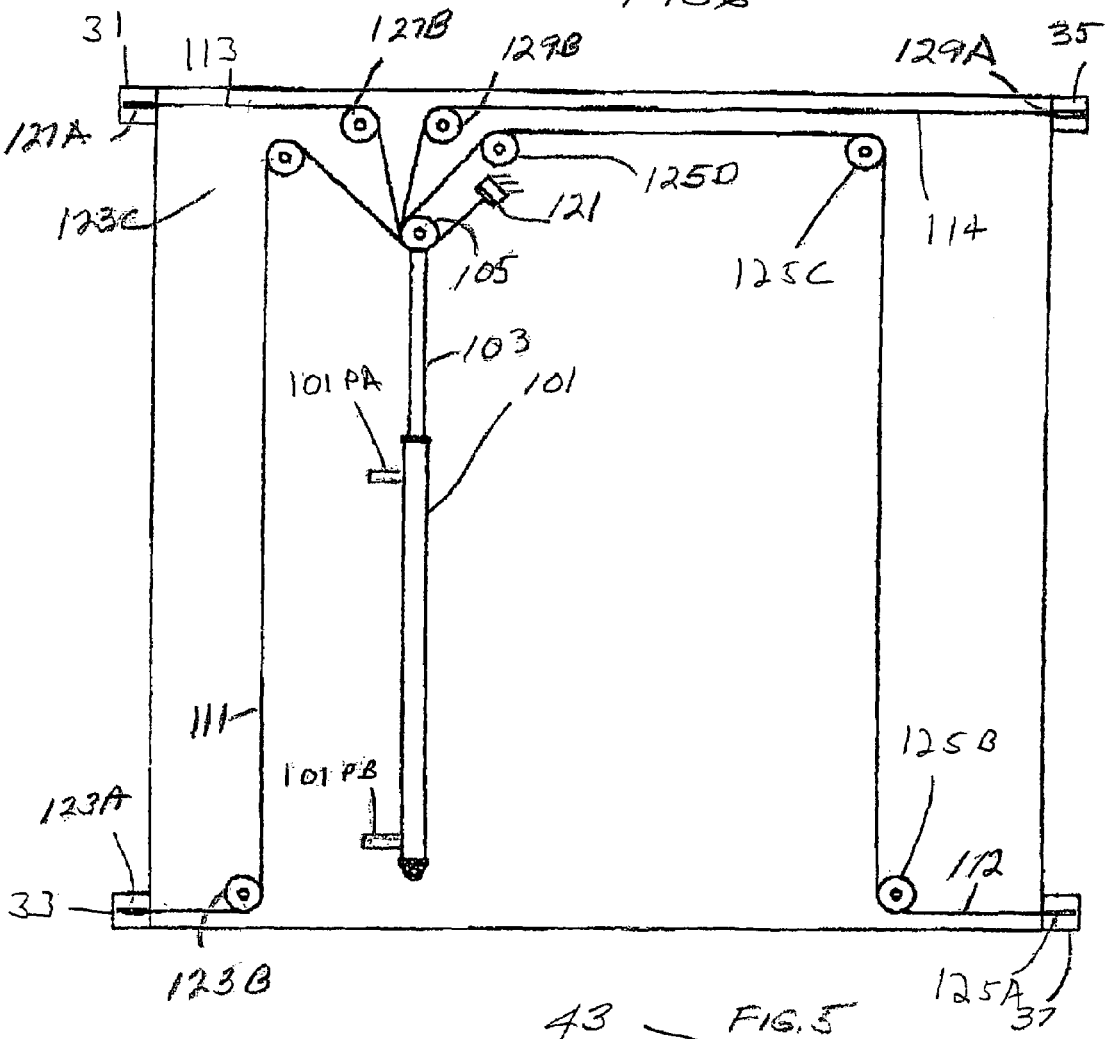
FIG. 6 schematically illustrates a hydraulic system for moving the platform upward or downward.

In one embodiment, the lifting mechanism may be a hydraulic cylinder 101 and piston 103 as schematically illustrated in FIG. 6. The hydraulic pump, reservoir and other components for operating the cylinder 101 are not shown. The cylinder 101 is coupled or anchored to one of the posts or to the concrete base 41. The outer end of the piston 103 has a pulley 105 pivotally coupled thereto. The hydraulic cylinder can be located beneath the platform 51. Coupled to the ends of the beams 53B, 55B, 53A, 55A are four cables 111, 112, 113, 114, which cables extend through the post slots 43, around pulleys and then around the pulley 105 to structure 121 fixed to the posts or base 41. (Alternatively, chains can be used.) Cable 111 extends to the pulley 105 by way of pulleys 123A, 123B, 123C, and cable 112 extends to the pulley 105 by way of pulleys 125A, 125B, 125C, 125D. Cable 113 extends to pulley 105 by way of pulleys 127A, 127B and cable 114 extends to pulley 105 by way of pulleys 129A, 129B. When hydraulic fluid is injected into the cylinder 101 by way of port 101PA and released by way of port 101PB, the piston 103 contracts or moves inward into the cylinder 101 causing the cables to pull the platform upward. When hydraulic fluid is injected into port 101PB and released from port 101PA, the piston 103 is moved outward from the cylinder 101 and the platform moves downward. Alternatively, the cylinder 101 could be secured to the underside of the platform 51, with the other ends of the cables 111–115 secured to the posts.

Also provided are side guard rails 131 coupled to the outer edges of the platform 51. A ladder 133 fixed to one of the posts allows workers to ingress and egress the platform 51 regardless of the vertical position of the platform. A gate is provided in the railing 131 at the ladder. The ladder allows access to the platform when the platform must remain at a fixed weight for extended periods of time. The side guard rails 131 can be removed.

One or more controllers 97, 99 allows one or more workers to raise or lower the platform 51. There is a stationary controller 97 located on the base 41. The platform 51 itself has a controller 99. The controllers have a "raise" button, a "lower" button and an emergency stop button. The controllers operate the hydraulic pump and release valves to cause the cylinder 101 to extend or retract the piston 103. The lifting mechanism can be electric over hydraulically operated or it can be completely electric based.

In operation, the platform 51 is raised to its highest position. The vertically oriented engine 11, on its base 13, is moved into a position under the platform 51, so as to be aligned with the opening 85. The base is rendered immobile and the platform is then lowered. The lift has various safety features such as multiple locking systems, audible and flashing alarms when the platform is raised or lowered, limit switches that prevent the platform from being raised too high or too low, etc. The locking systems can include cam locks inside the posts or air locks.

As the lift is lowered, the engine 11 enters the opening 85. The platform is typically lowered to the largest diameter portion of the engine. Once the platform is so positioned, then the filler plates are installed so as to minimize the annulus between the engine and the platform. The guard rail can then be put in place if desired and workers can then begin working on the engine.

The platform 51 allows access to the complete circumference of the engine, all along the length of the engine. Workers can move on the platform to access various circumferential engine locations. If the location is too high or too low, the platform 51 can be raised or lowered accordingly to provide access. The platform can also contain tools, tool cabinets, desks, computers, testing equipment or other necessary items for the assembly or maintenance of the engine 11. By offsetting the opening 85 from the center of the platform 51, as shown in the figures, this support equipment can be located away from the engine and allows for an unobstructed work area around the circumference of the engine. In addition, the platform can be provided with air, electrical and computer (such as Ethernet) connections. When the platform is high enough, workers can access the lower parts of the engine from beneath the platform.

Any fluids that leak from the engine will drain to the floor, where they can be cleaned up or directed to a drain location such as a disposal system. The concrete base 41 typically will not allow fluids to leak therethrough, thus minimizing environmental problems.

To remove the engine from the platform, the installation procedures are reversed.

The engine 11 is preferably supported by its base 13 so that the platform need not contact the engine. If the platform is required to support the engine, then rolling bumpers can be provided between the engine and the platform. The bumpers can be located beneath the platform so as not to interfere with the workspace above the platform.

The lift can operate as a specific station on an assembly line or it can be installed in a stand alone environment. The lift can be clear overhead in one or more directions so as to not interfere with overhead cranes. The lift can be unanchored (unbolted) from the base 41 and then moved with relative ease to a new location. Consequently, the lift frees up space in a plant and eliminates the need for in ground pits as well as some overhead assembly units.

The foregoing disclosure and showings made in the drawings are merely illustrative of the principles of this invention and are not to be interpreted in a limiting sense.

The invention claimed is:

1. An apparatus, comprising:

a) vertically oriented support posts spaced apart from one another;

b) a platform extending between and supported by the posts, the platform comprising support structure and decking on top of the support structure, there being an opening in the support structure and the decking, which opening is structured and arranged to receive an engine;

c) a lifting mechanism to raise and lower the platform along the posts;

d) a vertically oriented engine located inside of the opening.

2. The apparatus of claim 1 wherein the engine comprises an aircraft engine.

3. The lift apparatus of claim 1, further comprising a guard rail around the opening.

4. The lift apparatus of claim 1 wherein the platform decking further comprises filler plates that surround the opening, the filler plates allowing the size of the opening to be adjusted.

5. The lift apparatus of claim 1 wherein the support structure further comprises a hoop-shaped beam located around the opening.

6. The lift apparatus of claim 5 wherein the hoop-shaped beam is coupled to the support structure by tangential members.

7. The lift apparatus of claim 1 further comprising a controller lift mechanism.

8. The lift apparatus of claim 1 wherein:

a) the platform decking further comprises filler plates that surround the opening, the filler plates allowing the size of the opening to be adjusted;

b) the support structure further comprises a hoop-shaped beam located around the opening;

c) the hoop-shaped structure is coupled to the support structure by tangential members.

* * * * *